US006324816B1

(12) United States Patent
Yamamoto

(10) Patent No.: US 6,324,816 B1
(45) Date of Patent: Dec. 4, 2001

(54) METHOD AND APPARATUS FOR INSERTING A TITLE SHEET INTO AN OPTICAL DISK CASE

(75) Inventor: Kaoru Yamamoto, Kyoto (JP)

(73) Assignee: Kyoto Seisakusho Co., Ltd., Kyoto (JP)

( * ) Notice: Subject to any disclaimer, the term of this patent is extended or adjusted under 35 U.S.C. 154(b) by 0 days.

(21) Appl. No.: 09/519,407

(22) Filed: Mar. 3, 2000

(30) Foreign Application Priority Data

Jan. 14, 2000 (JP) ..... 12-005339

(51) Int. Cl.[7] ..... B65B 63/04

(52) U.S. Cl. ..... 53/429; 53/474; 53/389.1; 53/254

(58) Field of Search ..... 53/429, 474, 468, 53/157, 238, 251, 254, 389.1

(56) References Cited

U.S. PATENT DOCUMENTS

| | | | | |
|---|---|---|---|---|
| 4,685,277 | | 8/1987 | Ilsemann . | |
| 4,881,356 | | 11/1989 | Beezer et al. . | |
| 5,207,050 | | 5/1993 | Fulkerson et al. . | |
| 5,285,620 | | 2/1994 | Kaye et al. . | |
| 5,664,405 | * | 9/1997 | Perego | 53/468 |
| 5,694,743 | * | 12/1997 | Beighle | 53/468 |
| 5,788,114 | | 8/1998 | Perego . | |
| 5,816,028 | | 10/1998 | Zaniboni . | |
| 5,943,845 | | 8/1999 | Ilsemann . | |
| 5,950,401 | * | 9/1999 | Blohm et al. | 53/254 |
| 6,115,998 | * | 9/2000 | Reh et al. | 53/429 |
| 6,233,909 | | 5/2001 | Onishi . | |

FOREIGN PATENT DOCUMENTS

| | | |
|---|---|---|
| 0552025 | 7/1993 | (EP) . |
| 11-217277 | 8/1999 | (JP) . |
| 2001-48118 | 2/2001 | (JP) . |

* cited by examiner

*Primary Examiner*—Peter Vo
*Assistant Examiner*—Sam Tawfik
(74) *Attorney, Agent, or Firm*—W. F. Fasse; W. G. Fasse

(57) ABSTRACT

A title sheet inserting machine includes a rotatable turret having a plurality of equally spaced copes, which each have a corrugated contact face adapted to hold a title sheet. A drag is provided movably toward and away from the cope at the first station of the turret. A space forming device provided adjacent to the second station of the turret is adapted to form a title sheet insertion space in the case. A case transferring pusher transfers the case formed with the title sheet insertion space therein toward the cope placed at the second station of the turret. A case retreating pusher retreats the case having the title sheet therein from the cope placed at the third station of the turret.

14 Claims, 8 Drawing Sheets

METHOD AND APPARATUS FOR INSERTING A TITLE SHEET INTO AN OPTICAL DISK CASE

BACKGROUND OF THE INVENTION

The present invention relates to the field of automated packaging, and more specifically, to a method of inserting a title sheet or an apparatus for inserting same into a plastic case for an optical disk such as CD (i.e. Compact Disk), DVD (i.e. Digital Video Disk) or the like.

A title sheet is a flexible sheet on which a title of the optical disk and other visual information are printed. A case for an optical disk generally has an openable case body. An optical disk is loaded into one side of the case body and a description sheet is inserted into the other side of the case body. On the front face of the case body is provided a transparent cover for inserting a title sheet.

Conventionally, as there were no automated packaging machines to load an optical disk and insert a title sheet into a case, these loading and inserting operations were performed by hand, which was very troublesome.

The solution to this problem is identified in Onishi, Japanese Patent Application No. 11-217277 and corresponding Japanese Patent Laying-Open Publication 2001-48118. As shown in Onishi, an automated optical disk loading machine is provided, whereby loading of an optical disk and insertion of a title sheet can be automatically conducted.

In operation, as a case conveyor conveys a plurality of cases, an optical disk loading device loads an optical disk into a case, a title sheet inserting device inserts a title sheet into the transparent cover of the case, and a description sheet inserting device inserts a description sheet into a claw portion of the case.

In inserting a title sheet into the case, as a suction pad holding an open case moves downward, the case body is bent into a flat, reversed V-shape. Thus, the transparent cover is deformed into a general V-shape by its own weight, which causes a title sheet insertion space to be formed in the case.

Then, a cope proceeds into the title sheet insertion space of the case with a corrugated title sheet held on the corrugated contact face of the cope. When the title sheet is separated from the cope in the title sheet insertion space, the title sheet is placed in the title sheet insertion space. Thereafter, the cope retreats from the title sheet insertion space.

In the process of title sheet insertion of the above-mentioned machine, after a cope holding the title sheet proceeds into the title sheet insertion space of the case, the cope must once retreat from the title sheet insertion space. Otherwise, the case cannot proceed to the next process. As a result, in the above-mentioned machine, it is impossible to further reduce the cycle time of the machine.

The main object of the present invention is to reduce the cycle time of the title sheet inserting machine.

SUMMARY OF THE INVENTION

The present invention is directed to a method of inserting a title sheet and an apparatus for inserting same into an optical disk case, which is formed of an openable or foldable case body and a transparent cover.

The method of inserting a title sheet includes the steps comprising:

(i) sandwiching the title sheet between a cope and drag, each of which has a corresponding corrugated contact face, and deforming the title sheet into a corrugated form at a first station of a rotatable turret, (ii) holding the corrugation-formed title sheet by the cope, (iii) moving the cope along with the title sheet to a second station by rotating the turret, (iv) forming a title sheet insertion space between the case body and transparent cover by bending the case body on the lateral side of the second station, (v) transferring the case formed with the title sheet insertion space toward the cope placed at the second station, and inserting the cope and the title sheet held thereby into the title sheet insertion space, (vi) moving the cope and title sheet along with the case to a third station by rotating the turret; and (vii) separating the title sheet from the cope and placing the title sheet in the title sheet insertion space at the third station, and retreating the case having a title sheet therein from the cope.

Preferably, the title sheet insertion space is formed by bending the case body into a flat, reversed V-shape to deform the transparent cover into a general V-shape.

The apparatus for inserting a title sheet includes a rotatable turret having a plurality of copes spaced equally and a drag provided approachably and retreatably relative to the cope at a first station of the turret. The apparatus also includes a space forming device to form a title sheet insertion space in the case and a case transferring device for transferring the case toward the cope at a second station of a turret to insert the cope along with the title sheet into the title sheet insertion space of the case. The apparatus further includes a title sheet separating device for separating the title sheet from the cope to place it in the title sheet insertion space, and a case retreating device to retreat the case from the cope at a third station of a turret.

Preferably, the space forming device bends the case body into a flat, reversed V-shape to deflect the transparent cover into a general V-shape.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
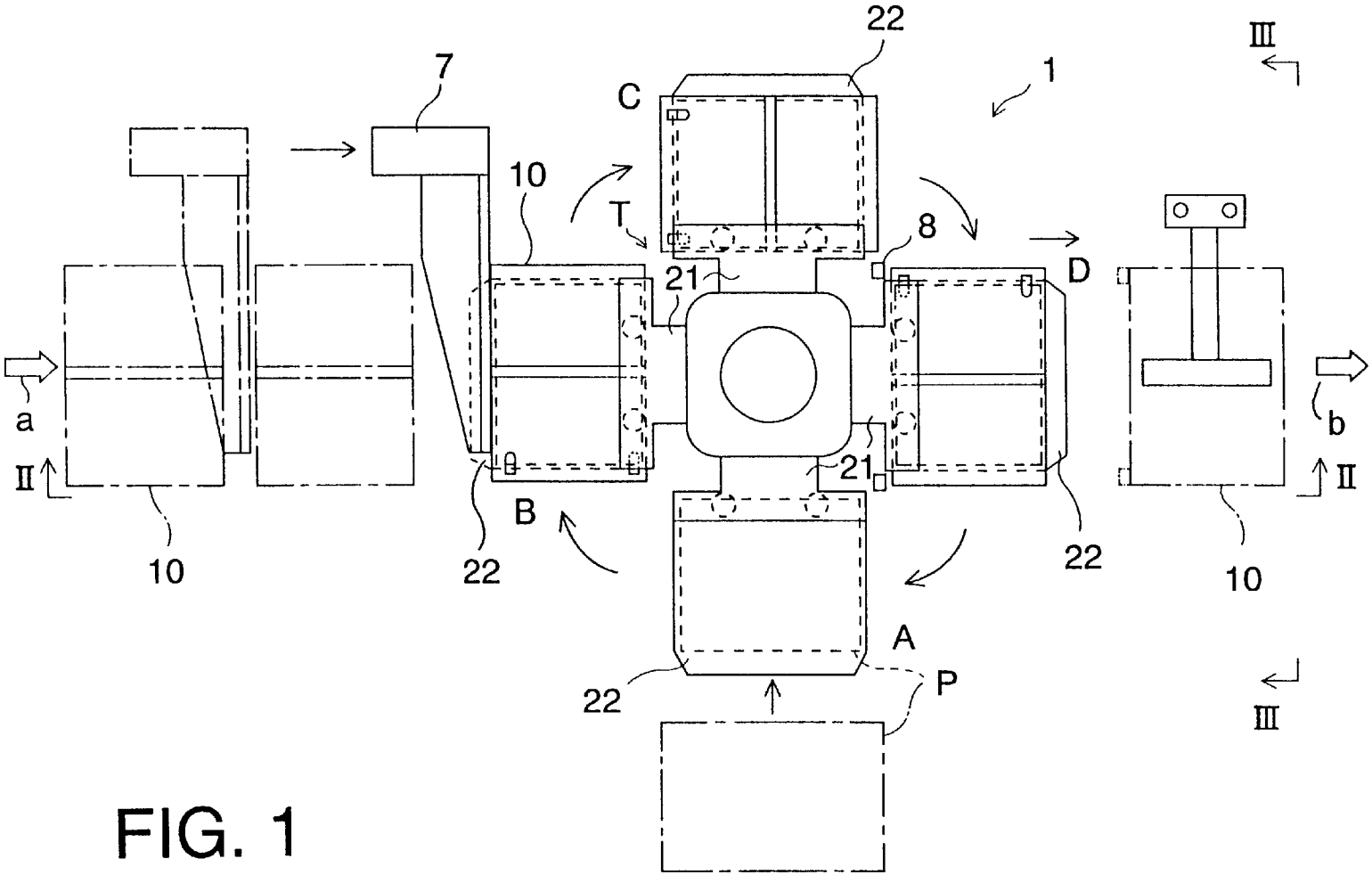
FIG. 1 is a top plan view of a title sheet inserting machine of the present invention.
Figure 2:
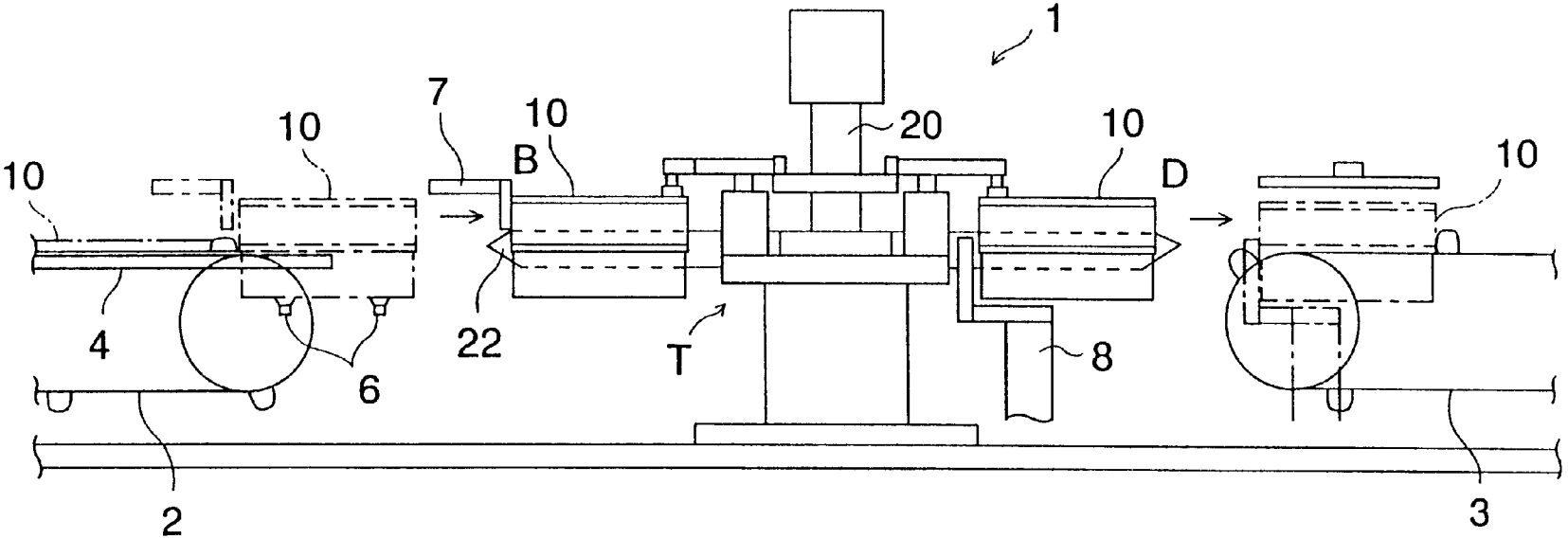
FIG. 2 is a front elevational view of the title sheet inserting machine of FIG. 1.

Referring now to the drawings, FIGS. 1 and 2 illustrate a title sheet inserting machine. As shown in FIGS. 1 and 2, this machine 1 is located between case conveyors 2 and 3. The case conveyor 2 coneys a case 10 in the direction shown by an arrow a prior to insertion of a title sheet P. The case conveyor 3 conveys a case 10 in the direction shown by an arrow b after insertion of the title sheet P.

Figure 4:
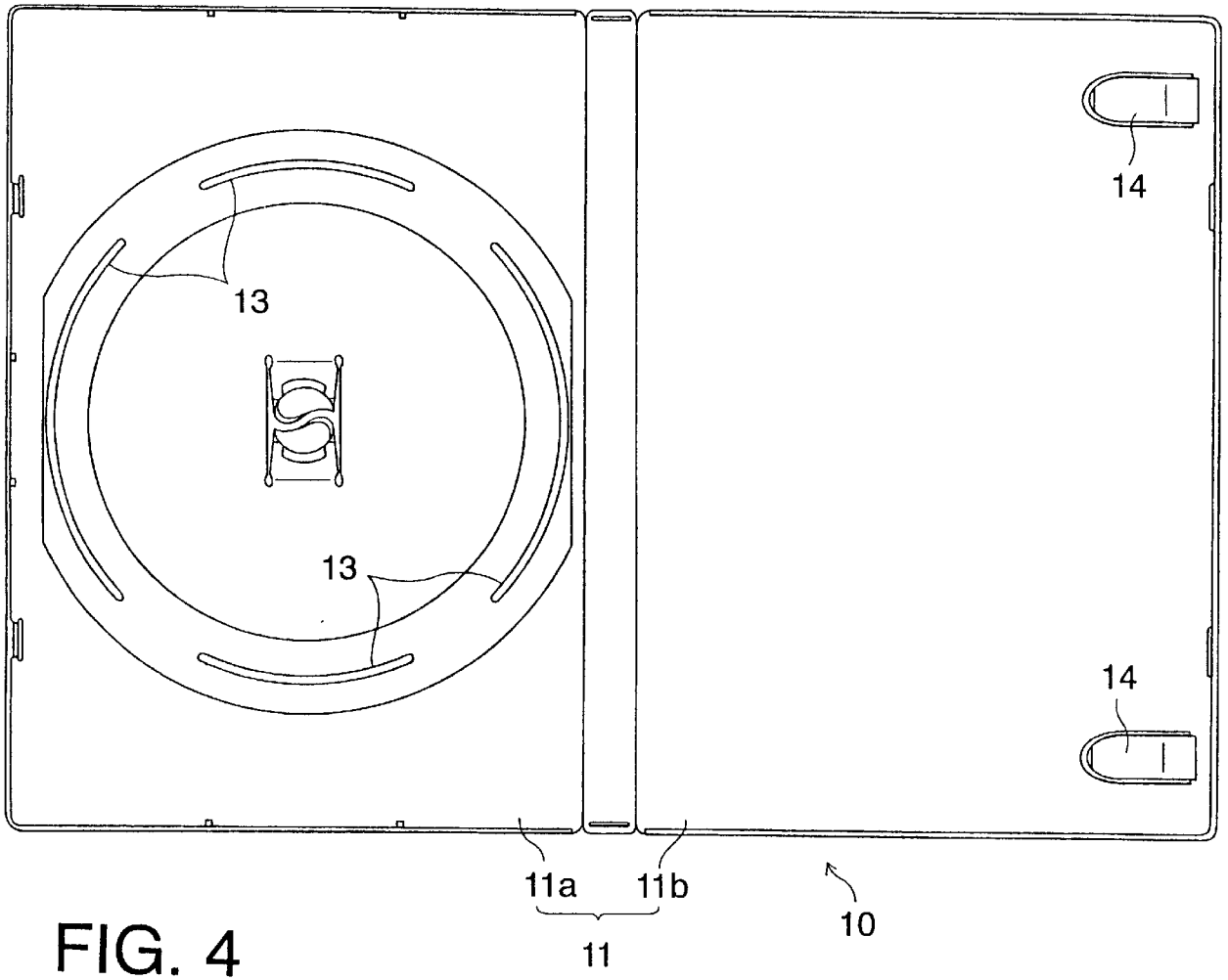
FIG. 4 is a top plan view of a case in a developed condition.
Figure 5:
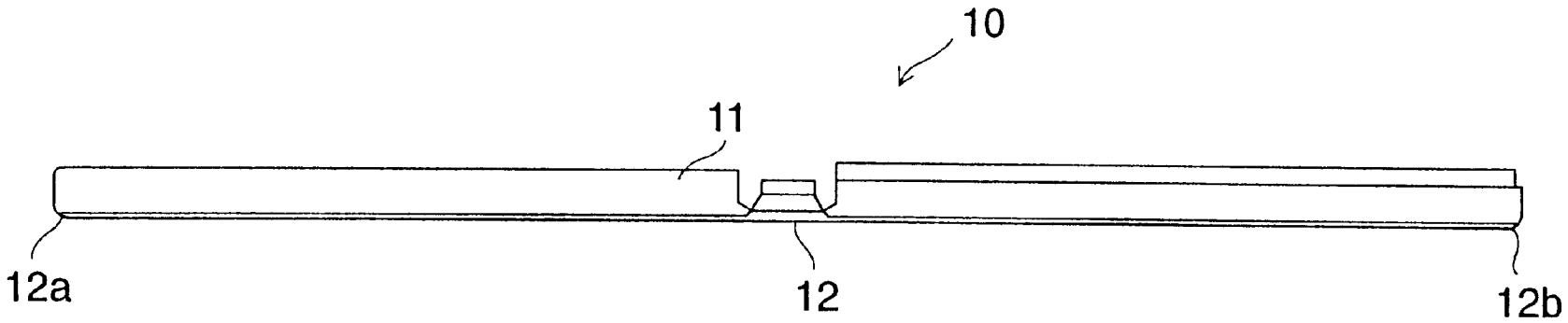
FIG. 5 is a side view of the case of FIG. 4.

As shown in FIGS. 4 and 5, a case 10 has a foldable or openable, box-shaped case body 11 and a transparent cover 12 provided on the front side of the case body 11. Both ends 12*a* and 12*b* of the transparent cover 12 are heat-sealed to the end portions of the front side of the case body 11.

On one side 11*a* of the case body 11 is formed a plurality of ridge portions 13 extending circumferentially. These ridge portions 13 form a loading hole for an optical disk (not shown). On the other side 11*b* of the case body 11 are provided a pair of holding claws 14 to hold a description sheet of the optical disk.

Figure 7:
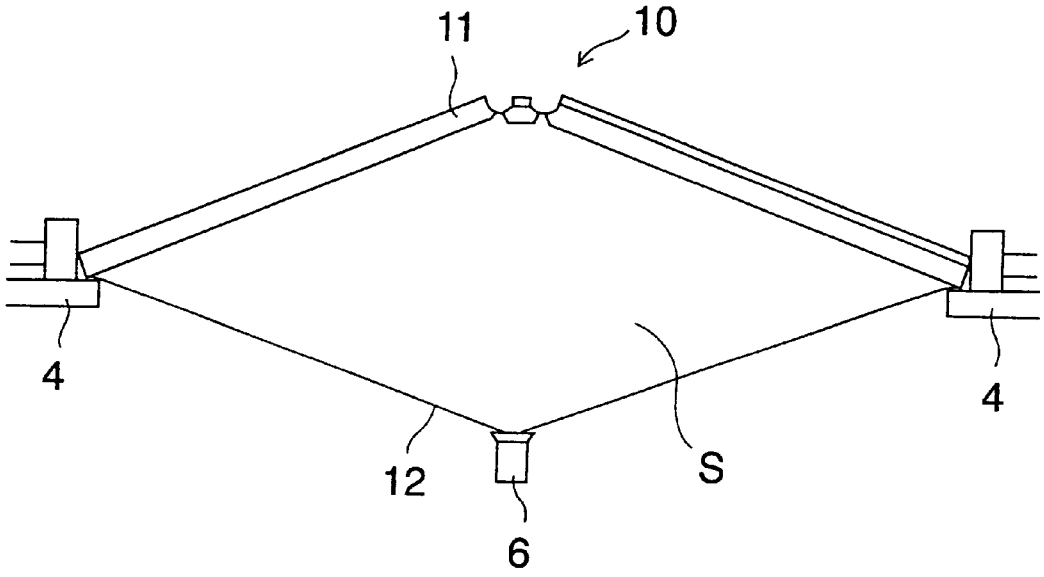
FIG. 7 is a schematic illustrating a case formed with a title sheet inserting space.

As shown in FIGS. 2 and 7, a pair of base plates 4 are provided along the arrow direction a. A plurality of movable suction pads (not shown) are provided above the base plates 4 to hold the case body 11 of the case 10 placed on the base plates 4. When these suction pads hold the case body 11 and move upward, the case body 11 deforms into a flat, reversed V-shape, shown in FIG. 7 and as a result, the transparent cover 12 bends down into a flat, general V-shape through its self-weight. Thus, a generally rhombus-shaped insertion space S for the title sheet P can easily be formed between the case body 11 and transparent cover 12.

In the middle of the space between the base plates 4, a suction pad 6 is provided to maintain an insertion space S by holding the transparent cover 12 of a case 10 formed with the insertion space S as described above and shown in FIG. 7.

As shown in FIGS. 1 and 2, a translatable pusher 7, or case transferring device, is provided between a case conveyor 2 and title sheet inserting machine 1 to introduce a case 10 on the case conveyor 2 into the title sheet inserting machine 1.

Figure 3:
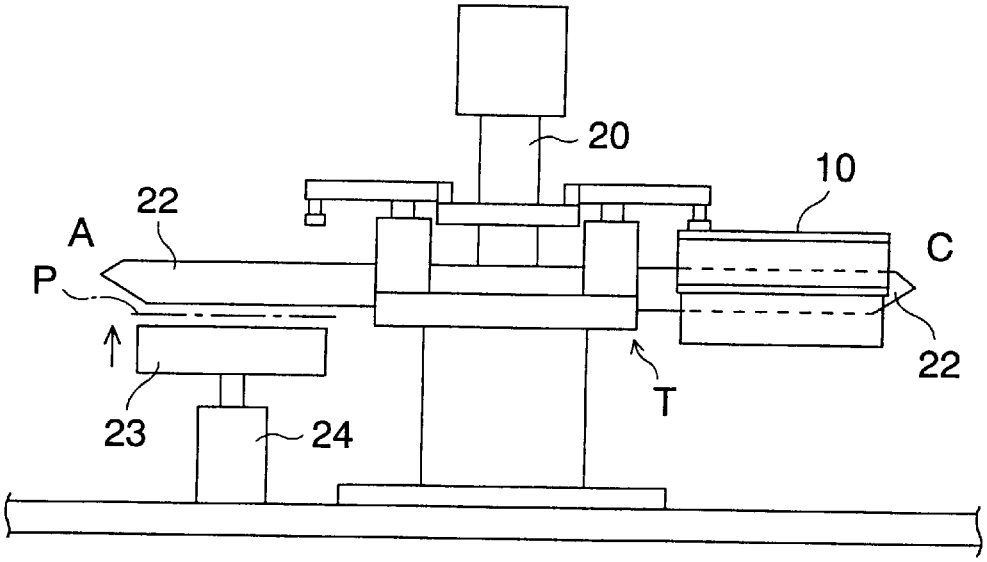
FIG. 3 is a side view of the title sheet inserting machine of FIG. 1.

The title sheet inserting machine 1, shown in FIGS. 1–3, has a turret T rotatable around a rotation shaft 20. The turret T includes four arms 21 disposed 90 degrees apart from each other and extending radially. A cope, or upper mold, 22 is attached to each of the arms 21.

Regarding each position of the cope 22, the position facing the case conveyor 2 is a second station, or station B, of the turret T, and the position facing the case conveyor 3 is a third station, or station D, of the turret T. Also, between the stations B and D are placed a first station, or station A, where a title sheet P is introduced, and a waiting station, or station C, disposed opposite to the station A. The se stations A, B, C, and D are spaced equally along the circle centered on the rotation shaft 20.

Figure 6:
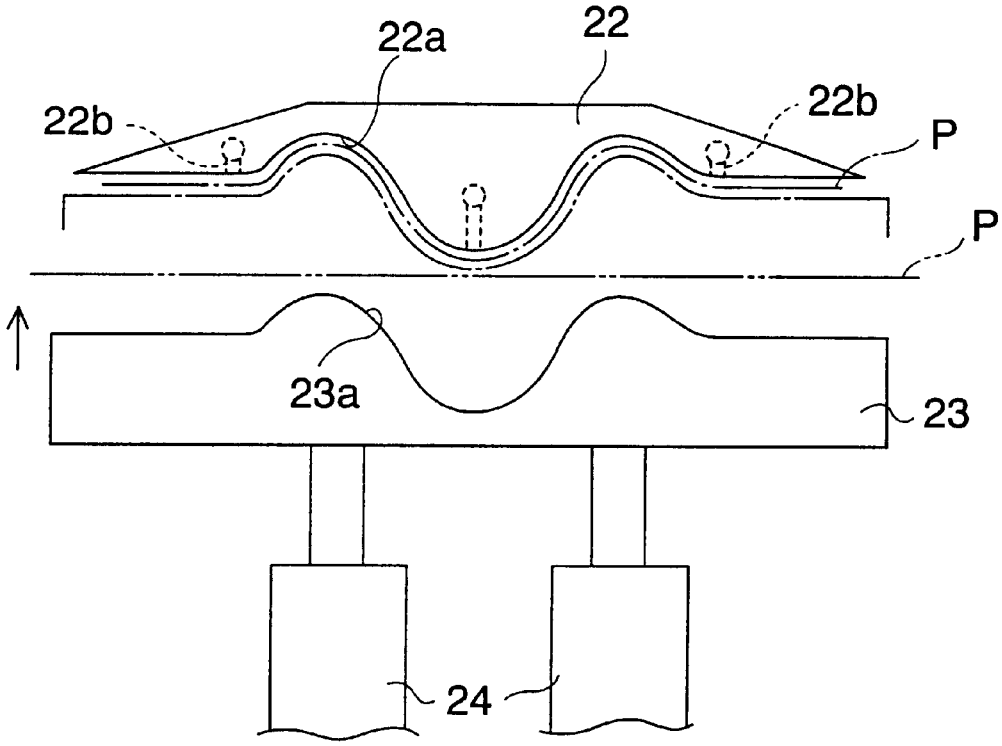
FIG. 6 is a schematic illustrating the process of deforming a title sheet into a corrugated form.

The cope 22 has a corrugated contact face 22*a* on its bottom surface, as shown in FIG. 6. On the corrugated contact face 22*a* are formed a plurality of holes 22*b* for suction of air or ejection of compressed air to attach or detach the title sheet P. These holes 22*b* are swichably connected to the vacuum pump or the source of the compressed air (not shown).

As shown in FIG. 3, at the station A of the turret T is provided a drag 23, or lower mold, placed against the cope 22 and movable in the upward and downward direction by the actuator 24. The drag 23 has a corrugated contact face 23*a,* shown in FIG. 6, on its upper surface, which corresponds to the corrugated contact face 22*a* of the cope 22.

A pusher 8, or case retreating device, shown in FIG. 2, is provided between the station D and the case conveyor 3 to push out the case 10 having the title sheet P therein toward the case conveyor 3.

Next, the insertion method by the title sheet inserting machine will be described hereinafter. In order to insert the title sheet P into the case 10, first, the title sheet P is introduced between the cope 22 and drag 23 at the station A of the turret T (see FIGS. 1 and 6). Then, as the actuator 24 drives the drag 23 upward, the title sheet P is sandwiched between the cope 22 and drag 23 (see FIGS. 1 and 6).

At this time, the corrugated contact faces 22*a,* 23*a* of the cope 22 and drag 23 contact tightly with each other, and the title sheet P is formed into corrugation corresponding to the corrugated contact faces 22*a,* 23*a*. Also, the air is drawn into a plurality of holes 22*b* on the contact face 22*a,* and the title sheet P is attached and held on the contact face 22*a* of the cope 22.

Then, the actuator 24 drives the drag 23 downward to retreat it from the cope 22. At this time, because the air is still drawn into the holes 22*b* on the contact face 22*a,* the title sheet P is still attached on the contact face 22*a* of the cope 22 even after retreat of the drag 23 from the cope 22. The turret rotates 90 degrees and the cope 22 having the title sheet P thereunder is transferred to the station B.

On the lateral side of the station B of the turret T, a developed case 10 conveyed in the arrow direction a by the case conveyor 2 is placed on the base plate 4. Then, by operating a suction pad (not shown), the case body 11 is deflected into a flat, reversed V-shape, and as a result, the transparent cover 12 bends downward and deforms into a flat, general V-shape through its self-weight. Thus, a general rhombus-shaped insertion space S, shown in FIG. 7, is formed between the case body 11 and transparent cover 12. The title sheet insertion space S is maintained by the suction pad 6.

Figure 8:
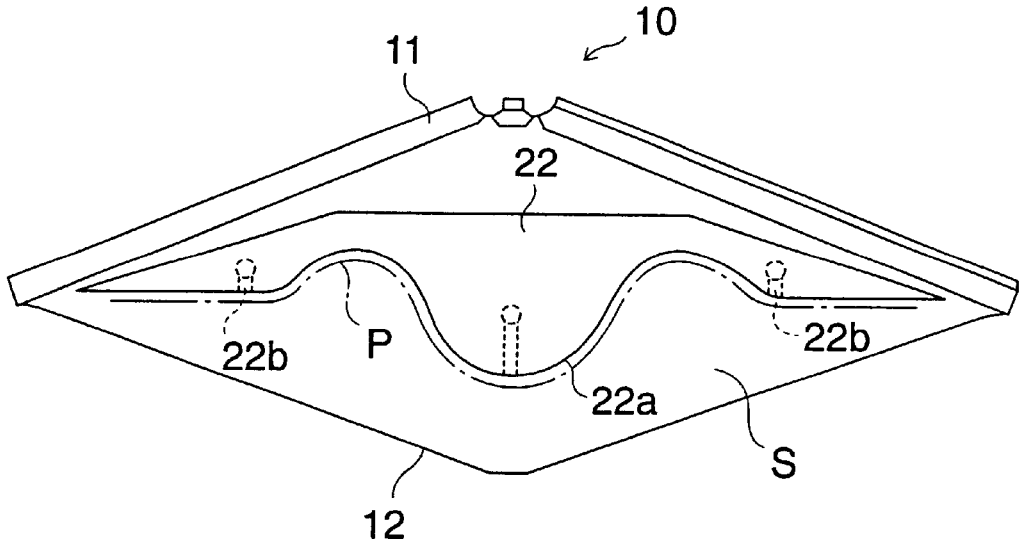
FIG. 8 is a schematic illustrating the process of inserting a corrugated title sheet into the title sheet inserting space of a case.

Then, the pusher 7 transfers the case 10 formed with the insertion space S toward the station B of the turret T, shown in FIGS. 1 and 2. In this way, as shown in FIG. 8, the cope 22 and the title sheet P attached thereon at the station B are inserted into the insertion space S of the case 10.

In this case, after the cope 22 attaching the title sheet P is inserted into the title sheet insertion space S of the case 10, without the necessity of retreat of the cope 22 from the insertion space S, the turret T rotates with the cope 22 and case 10 integrally combined. In this way, the case 10 can proceed to the next process soon after the title sheet insertion, which can reduce the cycle time of the whole system.

Then, by rotation of the turret T, the case 10 along with the cope 22 is transferred to the station D through the station C. At the station D, the compressed air is ejected from a plurality of holes 22*b* on the contact face 22*a* of the cope 22. By the pressure of the compressed air, the title sheet P attached on the contact face 22*a* of the cope 22 is separated from the contact face 22*a* and placed in the insertion space S.

In this condition, the pusher 8 transfers the case 10 at the station D toward the case conveyor 3, as shown in FIGS. 1 and 2. Then, the case 10 is separated from the cope 22 and delivered to the case conveyor 3. On the case conveyor 3, the case 10 is returned to the developed condition from the deflected one and transferred in the arrow direction b.

Alternatively, separation of the title sheet P from the cope 22 and delivery of the case 10 to the case conveyor 3 may be conducted at the station C. In this varied embodiment, the case conveyor 3 is provided at the station C and in the direction perpendicular to the case conveyor 2, which can further improve the process rate of the system.

Those skilled in the art to which the invention pertains may make modifications and other embodiments employing the principles of this invention without departing from its spirit or essential characteristics particularly upon considering the forgoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A method of inserting a title sheet into a disk storage case including a foldable case body and a flexible transparent cover, said method comprising the following steps:

a) at a first station, forming a title sheet into a corrugated shape and holding said title sheet on a corrugated surface of a cope;

b) while still holding said title sheet on said corrugated surface of said cope, moving said cope along with said title sheet from said first station to a second station;

c) forming a title sheet insertion space between a case body and a transparent cover of a disk storage case by deflecting said case body into a deflected condition in which said transparent cover is displaced away from said case body with said title sheet insertion space therebetween;

d) while holding said disk storage case in said deflected condition, moving said disk storage case into said second station and onto said cope so that said cope and said title sheet held on said corrugated surface of said cope are inserted into said title sheet insertion space;

e) after said step d), moving said cope along with said title sheet and said disk storage case from said second station to a third station; and f) at said third station, separating said title sheet from said corrugated surface of said cope while leaving said title sheet in said title sheet insertion space, and then moving said disk storage case with said title sheet in said title sheet insertion space away from said cope.

2. The method according to claim 1, further comprising moving said cope from said third station again to said first station and then repeating said steps a) to f) with another title sheet and another disk storage case.

3. The method according to claim 1, wherein said cope is mounted on a rotatable turret, and said steps of moving said cope from said first station to said second station and from said second station to said third station are carried out by rotating said turret.

4. The method according to claim 3, wherein said turret has a plurality of said copes mounted thereon at equal circumferential spacings relative to each other, and wherein each of said steps is carried out successively for each of said copes.

5. The method according to claim 4, further employing a single drag that has a corrugated surface corresponding to an inverse of said corrugated surface of said cope and that remains at and adjacent to said first station, wherein said step a) is carried out by sandwiching said title sheet between said corrugated surface of said drag and said corrugated surface of said cope so as to press said title sheet against said corrugated surface of said cope.

6. The method according to claim 3, wherein said first station and said second station are rotationally offset by 90 ° from each other, and said second station and said third station are rotationally offset by 180° from each other, respectively about a rotation axis of said turret.

7. The method according to claim 3, wherein said first station and said second station are rotationally offset by 90° from each other, and said second station and said third station are rotationally offset by 90° from each other, respectively about a rotation axis of said turret.

8. The method according to claim 1, wherein said step of holding said title sheet on said corrugated surface of said cope comprises applying suction through suction holes in said corrugated surface.

9. The method according to claim 1, wherein said step c) is carried out laterally adjacent to said second station.

10. The method according to claim 1, wherein said step c) is carried out by deflecting said case body into said deflected condition, in which said case body has an inverted V-shape while said transparent cover is deflected into a general V-shape protruding away from said case body with said title sheet insertion space therebetween.

11. An apparatus for inserting a title sheet into a disk storage case including a foldable case body and a transparent cover, said apparatus comprising:

a rotatable turret;

a plurality of copes that are mounted on said turret at equal circumferential spacings from each other, that each respectively have a first corrugated surface adapted to hold a title sheet thereon, and that are each movable by rotation of said turret successively to first, second and third stations around said turret;

a drag that is arranged at said first station adjacent to said turret, that has a second corrugated surface corresponding to an inverse of said first corrugated surface of each said cope, and that is arranged to be relatively movable toward and away from a respective one of said copes respectively located at said first station;

a space forming device that is arranged adjacent to said second station and that is adapted to form a title sheet insertion space between a foldable case body and a transparent cover of a disk storage case;

a case transferring device arranged and adapted to transfer the disk storage case from the space forming device to said second station so that a respective one of said copes that is located at said second station and that is carrying a title sheet is inserted into the title sheet insertion space; and a case removing device arranged and adapted to move the disk storage case away from said respective one of said copes after having moved to said third station, with the title sheet remaining in the title sheet insertion space.

12. The apparatus according to claim 11, further comprising a title sheet separating device adapted to separate the title sheet from said first corrugated surface of said cope at said third station to leave the title sheet in the title sheet insertion space.

13. The apparatus according to claim 11, wherein said space forming device includes case holders adapted to hold the storage case and deflect the case body into an inverted V-shape while the transparent cover is deflected into a general V-shape protruding away from the case body.

14. The apparatus according to claim 13, wherein said space forming device further includes a suction device adapted to hold the transparent cover away from the case body.

* * * * *